US005249567A

United States Patent [19]

Maitland et al.

[11] Patent Number: 5,249,567

[45] Date of Patent: Oct. 5, 1993

[54] MODULAR FIREPLACE ASSEMBLY

[75] Inventors: Kenneth R. Maitland; Terry G. Schoeff, both of Huntington; Philip D. Morgan, Noblesville, all of Ind.

[73] Assignee: Majco Building Specialities, L.P., Huntington, Ind.

[21] Appl. No.: 703,485

[22] Filed: May 21, 1991

[51] Int. Cl.[5] ..... F24B 1/181; F24B 1/19

[52] U.S. Cl. ..... 126/519; 126/548; 126/551; 126/500; 126/307 R; 126/312; 126/316; 126/512

[58] Field of Search ..... 126/58, 60, 64, 65, 126/66, 77, 307 R, 312, 316, 500, 509, 510, 512, 519, 531, 551, 548

[56] References Cited

U.S. PATENT DOCUMENTS

| | | | |
|---|---|---|---|
| 3,190,279 | 6/1965 | Davis | 126/531 |
| 4,003,361 | 1/1977 | Schutt | 126/500 |
| 4,126,118 | 11/1978 | Haynes | 126/509 |
| 4,129,114 | 12/1978 | Hiser | 126/509 |
| 4,177,791 | 12/1979 | Marchant | 126/66 X |
| 4,182,305 | 1/1980 | Johnson | 126/531 X |
| 4,319,556 | 3/1982 | Schwartz et al. | 126/15 A |
| 4,466,420 | 8/1984 | Ernisse et al. | 126/509 |
| 4,519,376 | 5/1985 | Schoeff et al. | 126/83 X |
| 4,700,687 | 10/1987 | Bailey et al. | 126/500 |
| 4,852,548 | 8/1989 | Shimek | 126/518 |
| 5,009,219 | 4/1991 | Liet | 126/531 X |
| 5,014,684 | 5/1991 | Meeker | 126/531 |
| 5,016,613 | 5/1991 | Maitland | 126/312 |

FOREIGN PATENT DOCUMENTS

| | | | |
|---|---|---|---|
| 2556079 | 6/1985 | France | 126/77 |
| 2597957 | 10/1987 | France | 126/500 |

*Primary Examiner*—Carl D. Price

*Attorney, Agent, or Firm*—Hoffmann & Baron

[57] ABSTRACT

A fireplace assembly is disclosed which provides a simplistic assembly technique that enables construction of numerous different fireplace models with a minimum of unique parts. These can be constructed into a desired form without the use of a frame. The internal components of the fireplace are secured to each other in such a manner that a frame is unnecessary. These components are also constructed such that many of them are interchangeable to enable fabrication of various types of fireplaces, such as see-through, cove, island and bay type fireplaces. A pair of combustion dome assemblies, each of which includes an upwardly extending nozzle, creates a significant upward suction within the combustion chamber. This provides superior air flow and combustion together with greater safety.

8 Claims, 20 Drawing Sheets

82
78
80
78
80
76
72
74
74
84
86
70
84
86
72

78
80
82
80
78
76
74
72
74
86
84
70
84
120
86
122

80
80
82
78
216
218
214
216
122
120
70A
70
120
122
84
86

78
80
82
78
122
120
70
70A
86
84
120
84
86
122

MODULAR FIREPLACE ASSEMBLY

BACKGROUND OF THE INVENTION

1. Field of the Invention

The field of the invention relates to factory built fireplaces.

2. Brief Description of the Prior Art

Factory built fireplaces are often employed instead of on site constructions due to advantages in installation, cost, and operation. Most such fireplaces are constructed from components which are unique to the particular type of fireplace (e.g. see-through, cove, etc.) which is to be assembled. A large number of parts must accordingly be stored and cataloged in order to satisfy the demands of consumers for different types of fireplaces.

One known fireplace is disclosed in U.S. Pat. No. 4,519,376. It includes a combustion chamber and a top wall assembly including a nozzle through which combustion gases are directed to a flue. A heat exchanger is provided for discharging heated air into a room. There is no mechanism by which such gases are encouraged to enter the flue other than the natural rising of the hot gases. The fireplace also is not readily converted to fireplaces having different constructions. Fireplaces of different types must accordingly be individually constructed, and generally have a minimal number of commonly shared parts.

An assembly which can be used for constructing a plurality of different types of fireplaces is disclosed in U.S. Pat. No. 4,852,548. A hollow, rectangular, prism-shaped frame is provided for supporting all six walls of a fireplace, including at least one wall including glass doors. The bottom wall thereof supports the fire brick for the combustion chamber. Different side panels may be assembled in order to provide see through, three sided or island type fireplaces.

Fireplaces which are convertible to solid fuel burning stoves have also been designed. U.S. Pat. No. 4,700,687 provides an example of one such design.

SUMMARY OF THE INVENTION

It is an object of the invention to provide a fireplace assembly which is easily assembled using a minimum number of parts.

It is another object of the invention to provide a fireplace assembly which provides superior air flow.

A still further object of the invention is to provide a fireplace assembly which can be used to construct a plurality of different types of fireplaces having a large number of common parts.

In accordance with these and other objects of the invention, a fireplace assembly is provided which includes front, back, side and top wall assemblies, a hearth pan, and at least one combustion dome assembly. In a preferred embodiment of the invention, a pair of combustion dome assemblies are used, each including an opening, the openings being in substantial vertical alignment. Means are provided for introducing air into the space between the combustion dome assemblies, thereby creating a strong upward flow from the fireplace combustion chamber and through the openings.

In accordance with another embodiment of the invention, an assembly is provided which can be used for constructing different types of fireplaces without the use of a frame. This assembly includes first and second front wall assemblies, each of which is usable in a different type of fireplace. A hearth pan is securable to either of the front assemblies. First and second side wall assemblies are also provided. The second side wall assembly includes a transparent panel. One or more of such side wall assemblies can be used with the respective front wall assemblies, depending upon the type of fireplace to be constructed. First and second rear wall assemblies are provided, at least one of which includes a glass door assembly. Finally, a base pan is provided which is securable to the hearth pan by structural members. The front wall assemblies each include vertical supports which allow the attachment of the respective side wall assemblies. This allows the various types of fireplaces to be assembled easily without a frame and using a large number of common parts.

An assembly which can be used to quickly and easily construct a variety of different fireplaces using a minimum number of parts is provided. The assembly will be described with respect to four different types of fireplaces, namely see-through, cove, bay and island fireplaces. See-through fireplaces include a pair of opposing windows or doors, the other two sides of the fireplaces being opaque. These doors can be an optional accessory. They are often installed in a wall dividing two adjoining rooms such that each room appears to have its own fireplace. Cove type fireplaces have three transparent walls, one end wall being opaque. Bay type fireplaces also have three transparent walls, the rear wall being opaque. Finally, island type fireplaces have four transparent walls, and are intended for use in the middle of a room.

DETAILED DESCRIPTION OF THE INVENTION

A fireplace assembly is disclosed which provides a simplistic assembly technique that enables construction of numerous different fireplace models with a minimum of unique parts. These can be constructed into a desired form without the use of a frame. The internal components of the fireplace are secured to each other in such a manner that a frame is unnecessary. These components are also constructed such that many of them are interchangeable to enable fabrication of various types of fireplaces, such as see-through, cove, island and bay type fireplaces.

Figure 1:
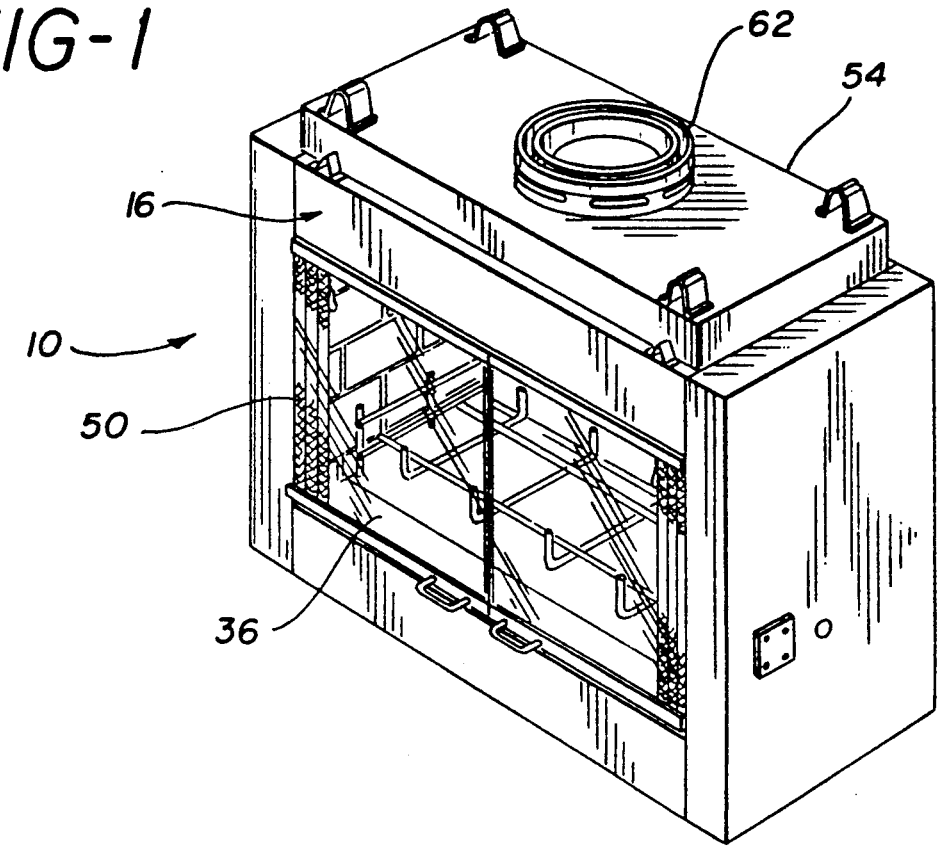
FIG. 1 is a top perspective view of a see-through fireplace according to the invention.
Figure 2:
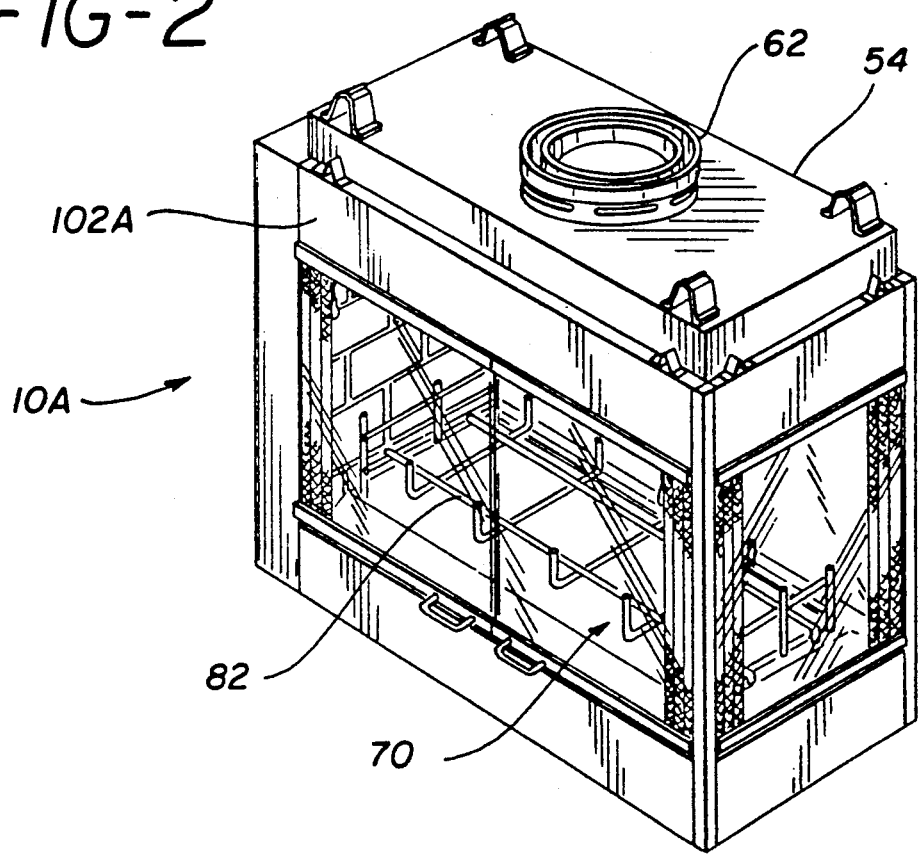
FIG. 2 is a top perspective view showing a cove type fireplace according to the invention.
Figure 1A:
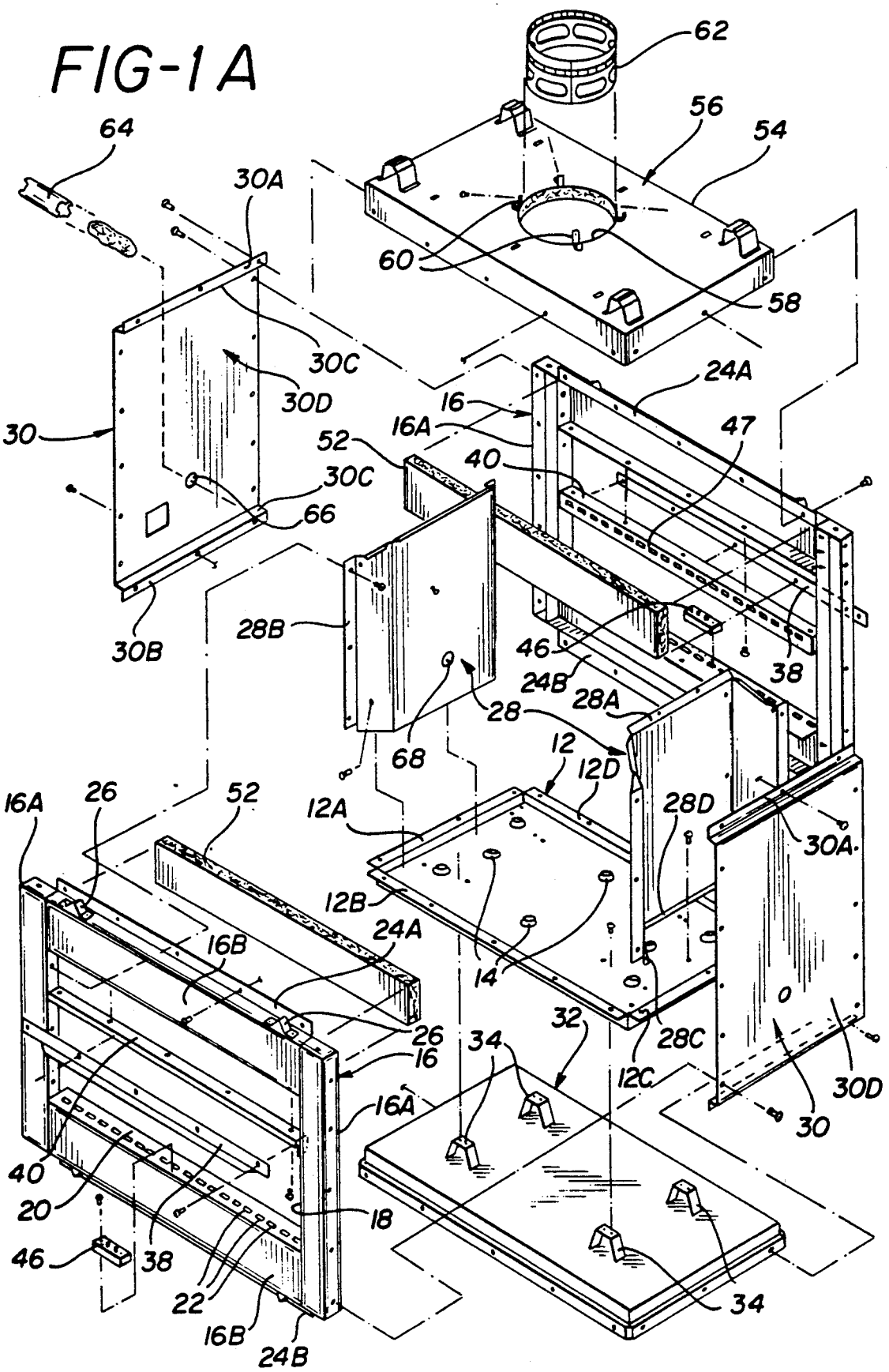
FIG. 1A is an exploded, perspective view of certain components thereof which define a combustion chamber.
Figure 1B:
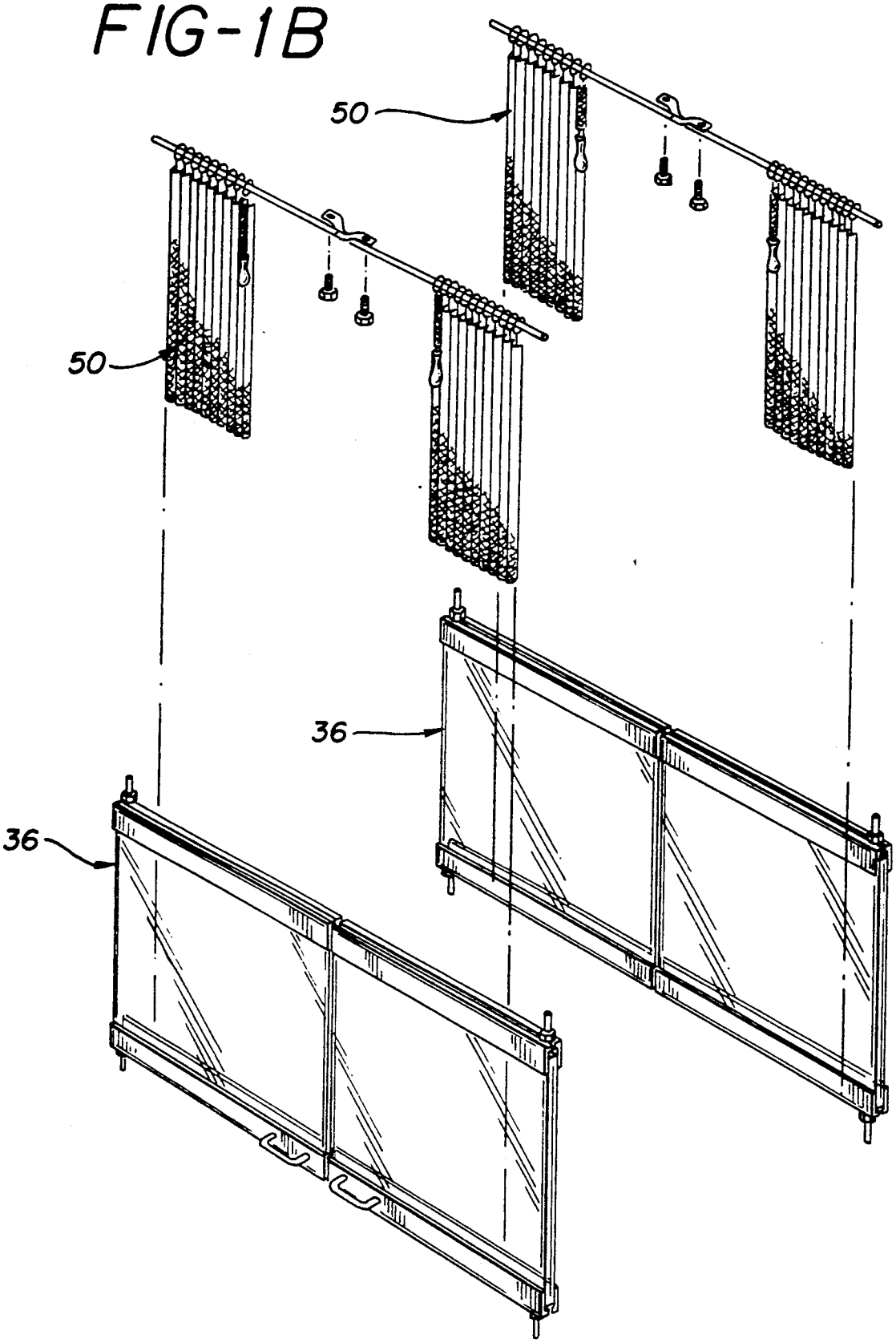
FIG. 1B is a perspective view thereof showing the door assemblies and screen assemblies thereof.

FIGS. 1 and 1A concern a see-through type fireplace in accordance with the invention. As will be described below, it includes many components common to other types of fireplaces, and can be assembled easily. The fireplace is self-supporting, and requires no frame upon which components must be mounted.

As shown in FIGS. 1 and 1A–1G, the see-through fireplace 10 includes a hearth pan 12 having four radially extending flanges 12A, 12B, 12C, 12D. Front and rear surround assemblies 16, each defined by a pair of first and second vertical surround sides 16A and top and bottom surround members 16B are mounted in opposing relation to each other. Each such assembly includes a rectangular opening 18 and a horizontally extending flange 20 extending inwardly from the bottom surround member which defines the lower boundary of the opening. A plurality of slots 22 extend through this flange for providing air to the interior of the fireplaces. Each surround assembly further includes an upwardly extending flange 24A and a plurality of brackets 26 mounted in opposing relation to the respective flanges. Bottom flanges 24B extend downwardly from the bottom of the respective front and rear surround assemblies.

The combustion casing sides 28 of the fireplace are each defined by members formed from stamped sheet metal or other suitable materials. Each combustion casing side includes an inwardly extending flange 28A and a pair of flanges 28B extending from the respective sides thereof. The flanges 28B are positioned within the respective openings 18 in the front and rear surround assemblies 16, and secured to the vertical walls thereof. Outwardly extending flanges 28C, 28D project horizontally from the bottom end of the combustion casing, and are secured to the hearth pan 12.

Left and right outer casing assemblies 30 define the outer members of the side walls of the fireplace. Each includes a pair of vertically extending flanges 30A, 30B extending, respectively, from the top and bottom walls 30C thereof. An end wall 30D connects the top and bottom walls 30C. The end walls 30D are to the ends of the respective front and rear surround assemblies. A space is accordingly maintained between the respective combustion casing sides 28 and the respective outer casing assemblies 30.

A base pan assembly 32 is mounted beneath the hearth pan 12. It includes a plurality of hearth supports 34, each of which is trapezoidal in configuration. The hearth supports are secured to the bottom of the hearth pan, thereby maintaining the hearth pan and base pan assembly in a substantially parallel, spaced relation. The edge portions of the base pan assembly are secured to the flanges 24B, 30B of the surround assemblies 16 and outer casing assemblies 30, respectively.

Figure 1C:
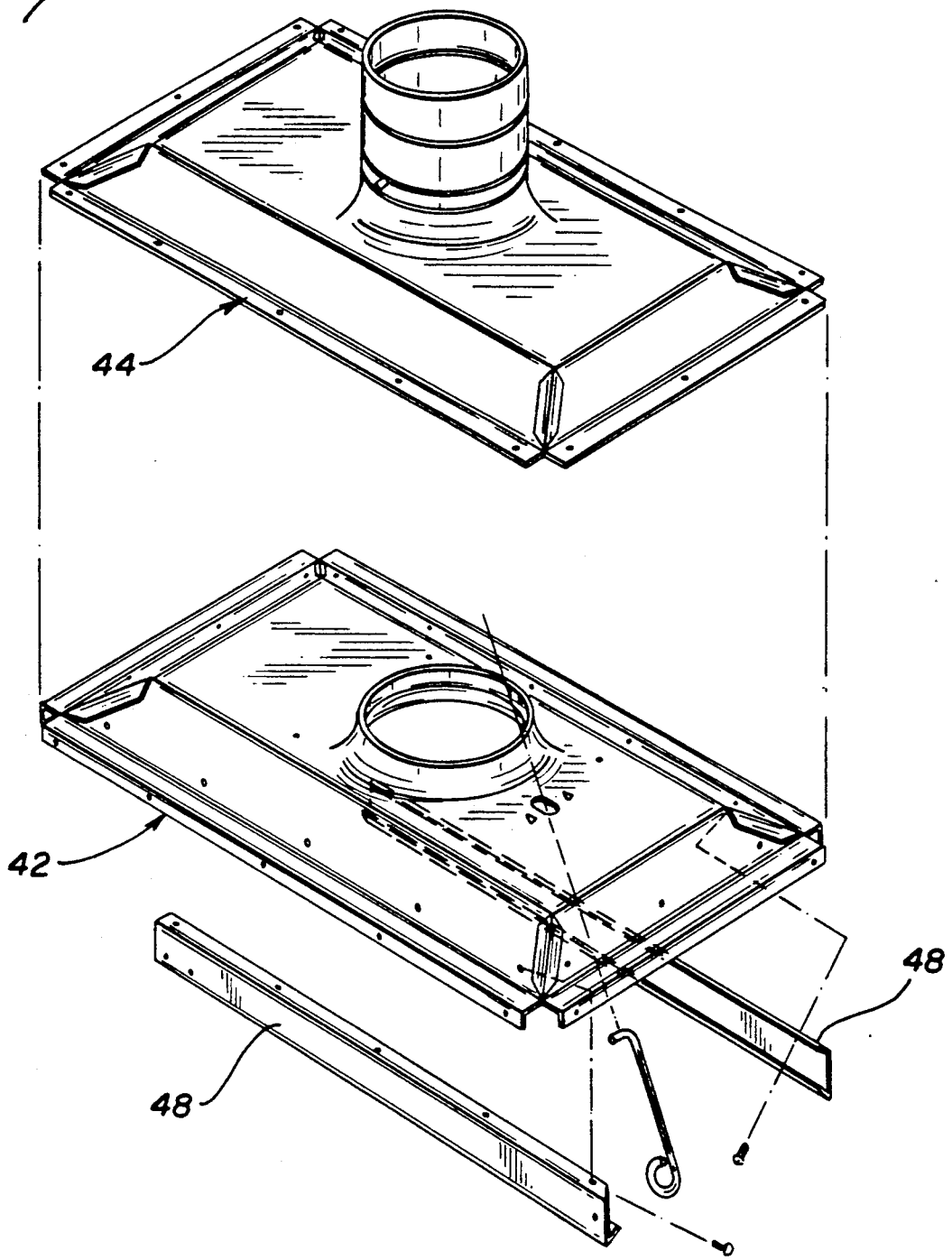
FIG. 1C is a top perspective view of the combustion dome assemblies thereof.
Figure 1D:
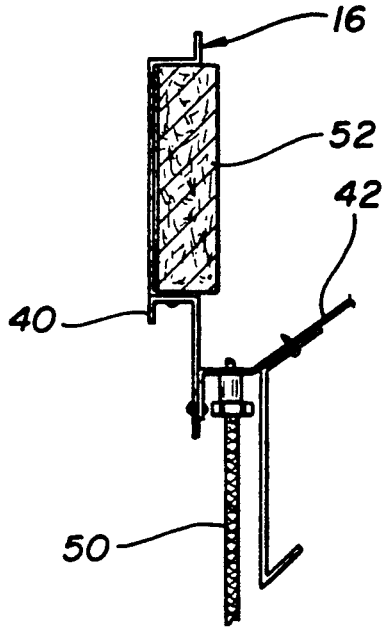
FIG. 1D is a sectional view thereof showing portions of one of the surround assemblies.
Figure 1E:
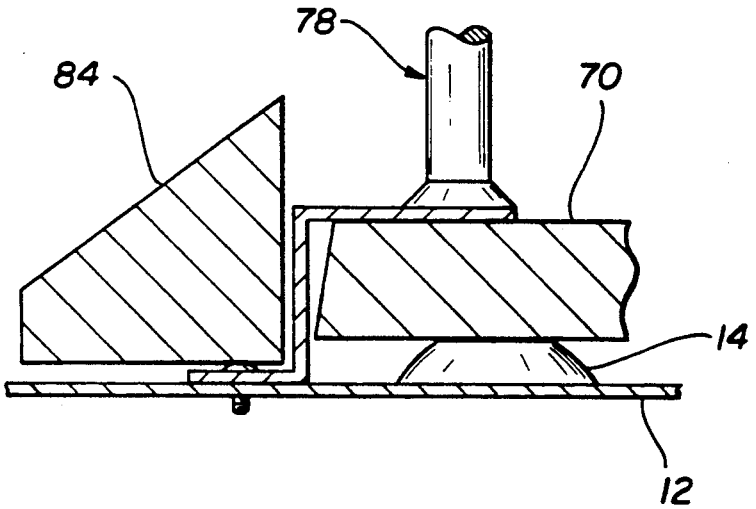
FIG. 1E is a sectional view thereof showing the hearth brick assembly.
Figure 1F:
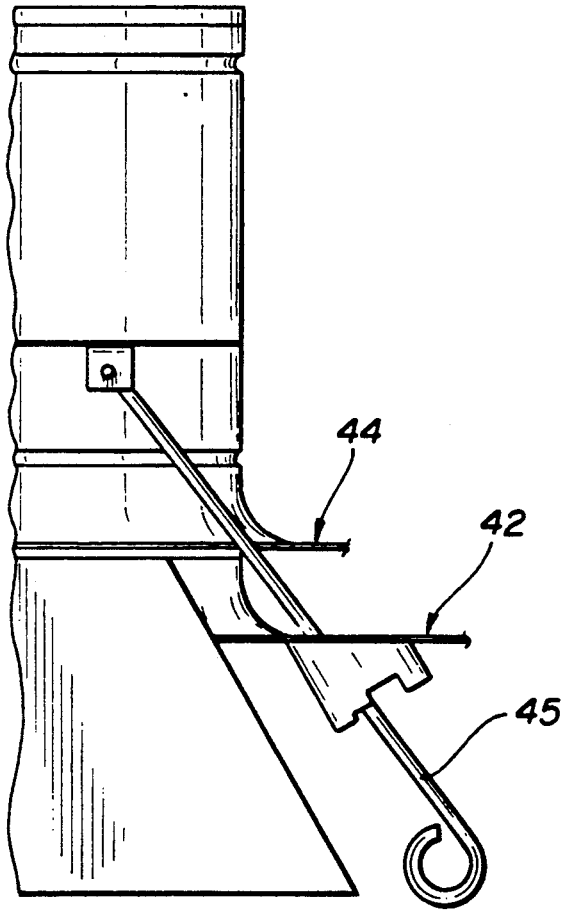
FIG. 1F is an elevation view thereof showing the combustion dome assemblies.

Two sets of door assemblies 36 (FIG. 1B) are mounted into the respective front and rear surround assemblies 16. A door seal 38 is secured to a door track 40 which is, in turn, secured to a primary combustion dome assembly 42 (FIG. 1C) on front and rear sides of the fireplace. The door tracks 40 are also secured to the upper walls of the respective surround assemblies 16, as well as to a secondary combustion dome assembly 44 (FIGS. 1C,1F). Catch plate assemblies 46 are respectively secured to the horizontally extending flanges 20 beneath each opening 18. The catch plate assemblies maintain the door assemblies 36 in the closed positions. A plurality of slots 47 extend through each of the door tracks 40.

The primary and secondary combustion dome assemblies 42,44 are assembled in spaced relationship, as described in commonly assigned U.S. Pat. No. 5,016,613 which is incorporated by reference herein. A pair of smoke shelves 48 are secured beneath the primary combustion dome assembly 42. Air is supplied to the space between the combustion domes by the slots 47 in the door tracks 40.

A pair of screen assemblies 50 (FIGS. 1B,1D) are provided for covering the front and rear surround openings 18 when fireplace is operated with doors open. Each screen assembly is secured to the primary combustion dome assembly 42. Insulation 52 is provided in the spaces above the respective openings 18.

An outer top assembly 54 is secured to the upper, vertically extending flanges 24A,30A of the surround assemblies 16 and outer casing assemblies 30, respectively. The outer top assembly includes a top wall 56 having a circular opening 58 therein. A plurality of brackets 60 are positioned about this opening. A collar 62 is secured to the brackets.

A gas line tube 64 extends through openings 66,68 in one set of outer casing assemblies 30 and combustion casings 28, respectively.

Figure 1G:
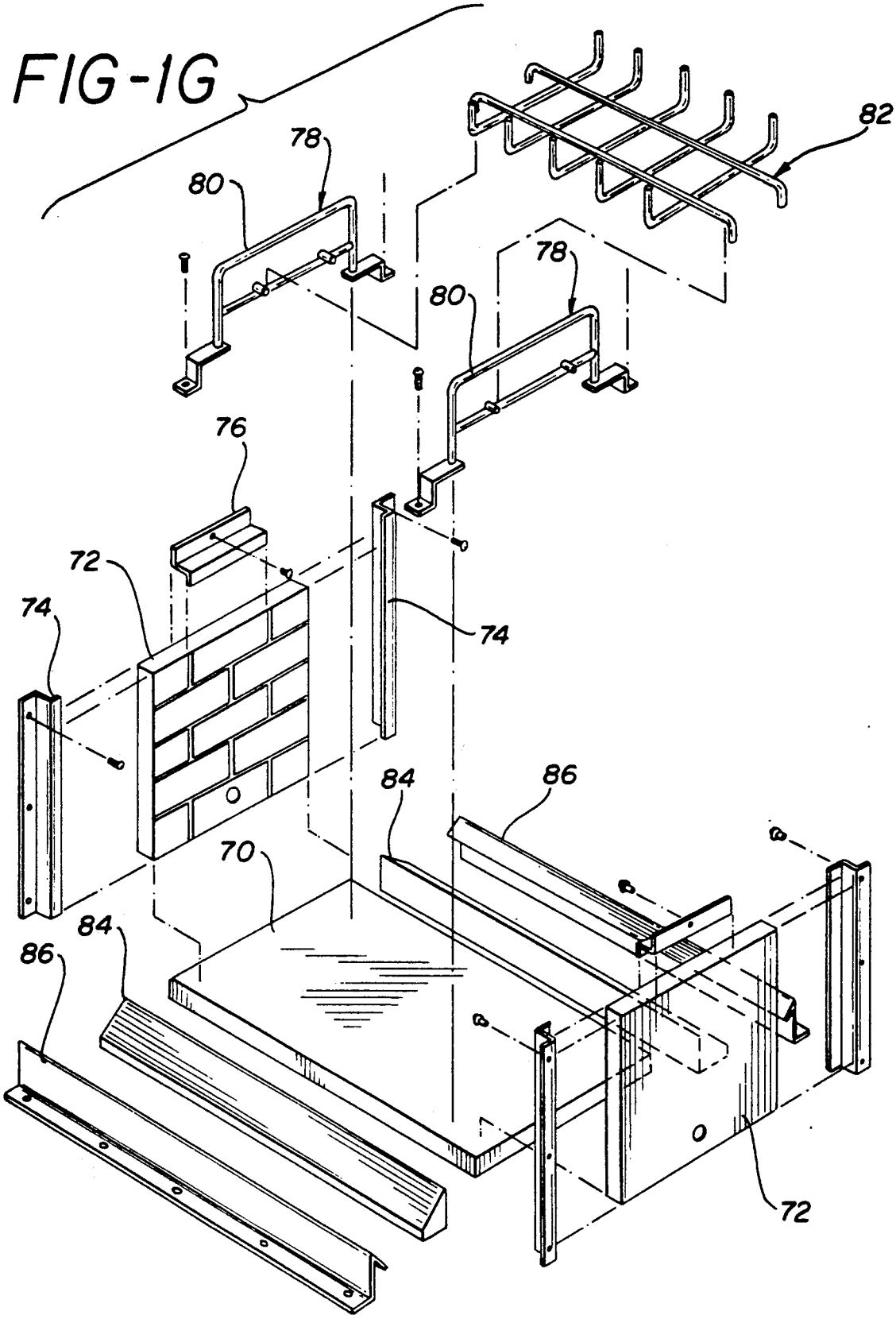
FIG. 1G is a top perspective view showing the hearth brick and side brick assemblies thereof.
Figure 2A:
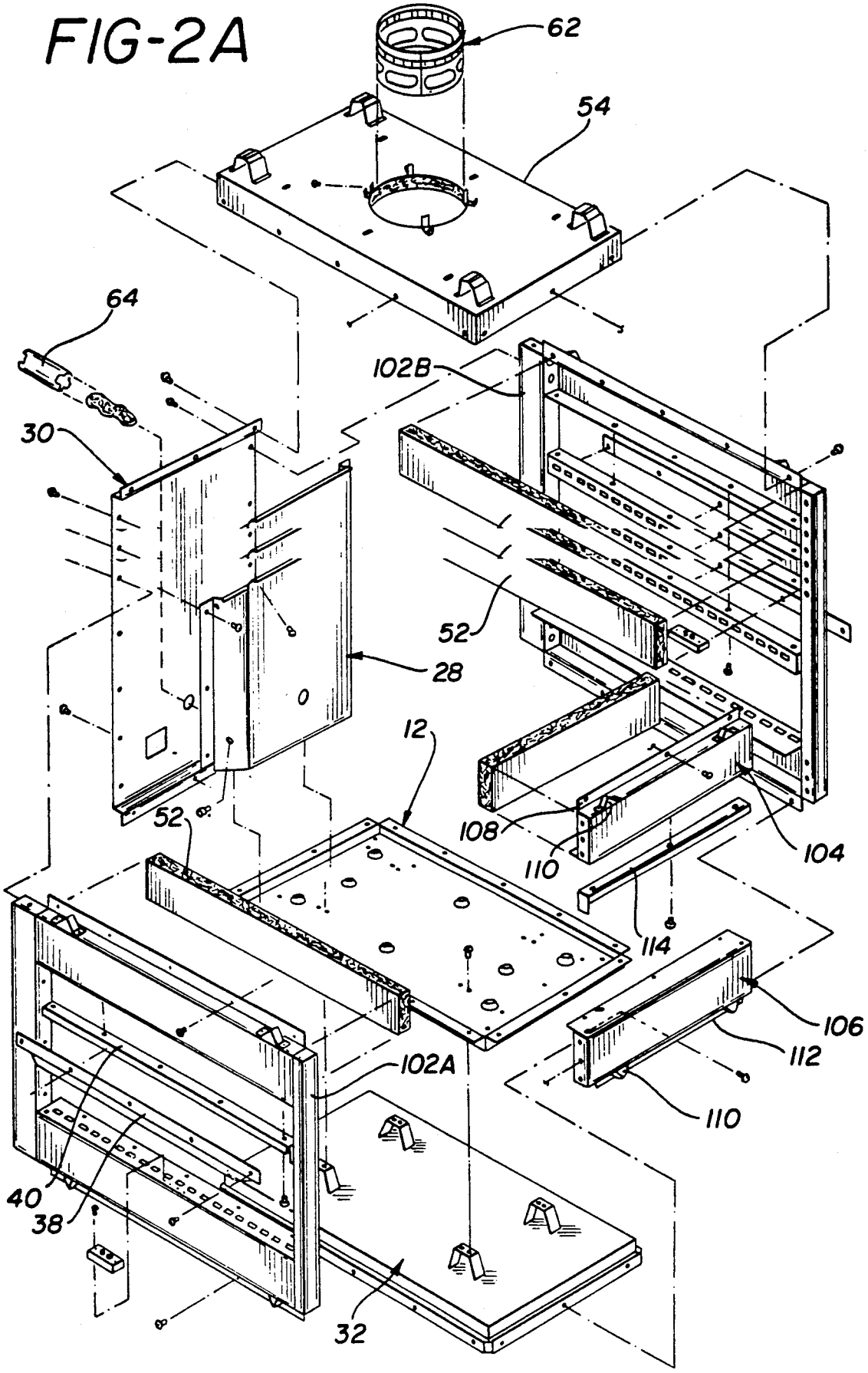
FIG. 2A is an exploded, perspective view of certain components thereof which define a combustion chamber.
Figure 2B:
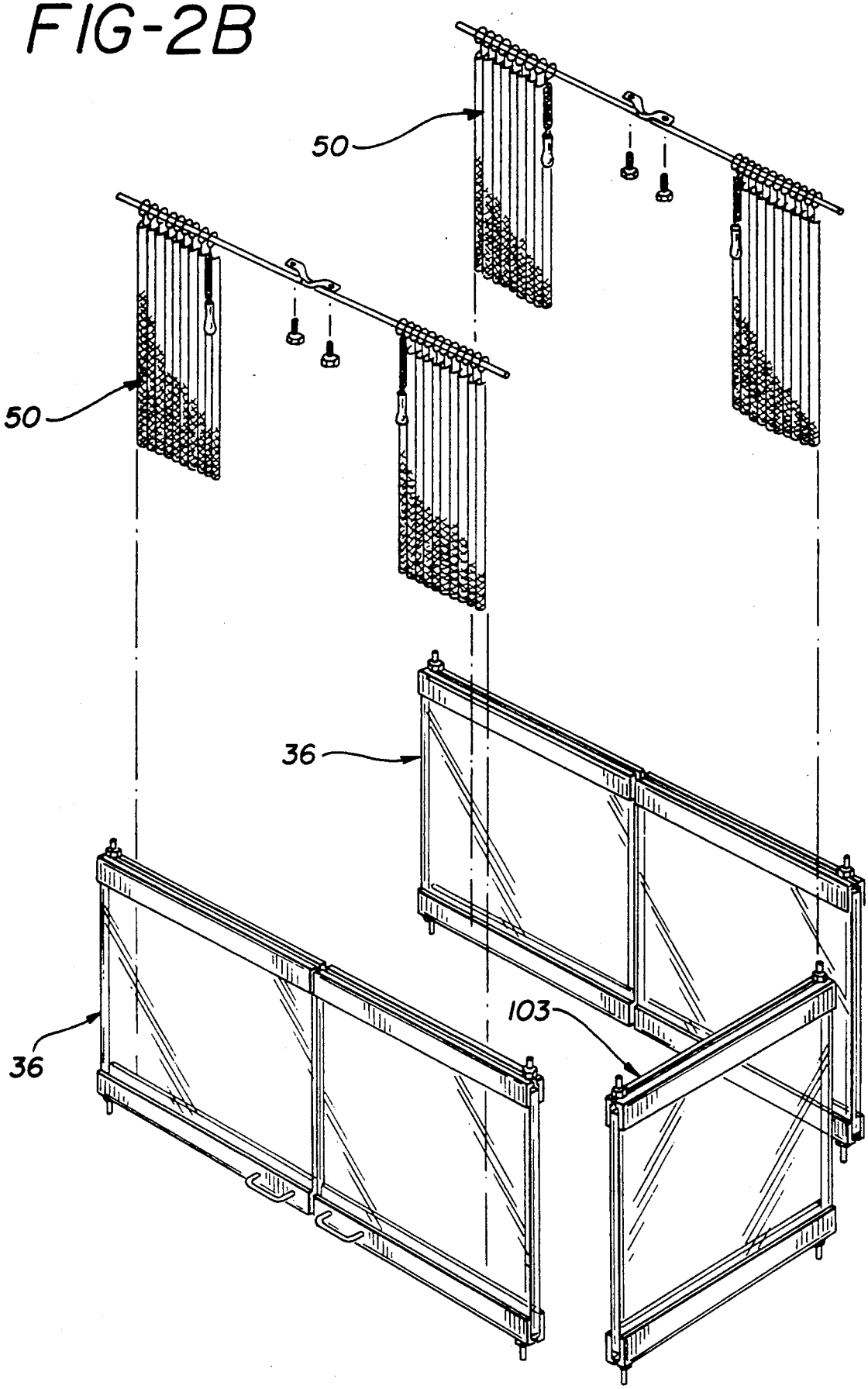
FIG. 2B is a perspective view showing the door assemblies, screen assemblies and windows thereof.
Figure 2C:
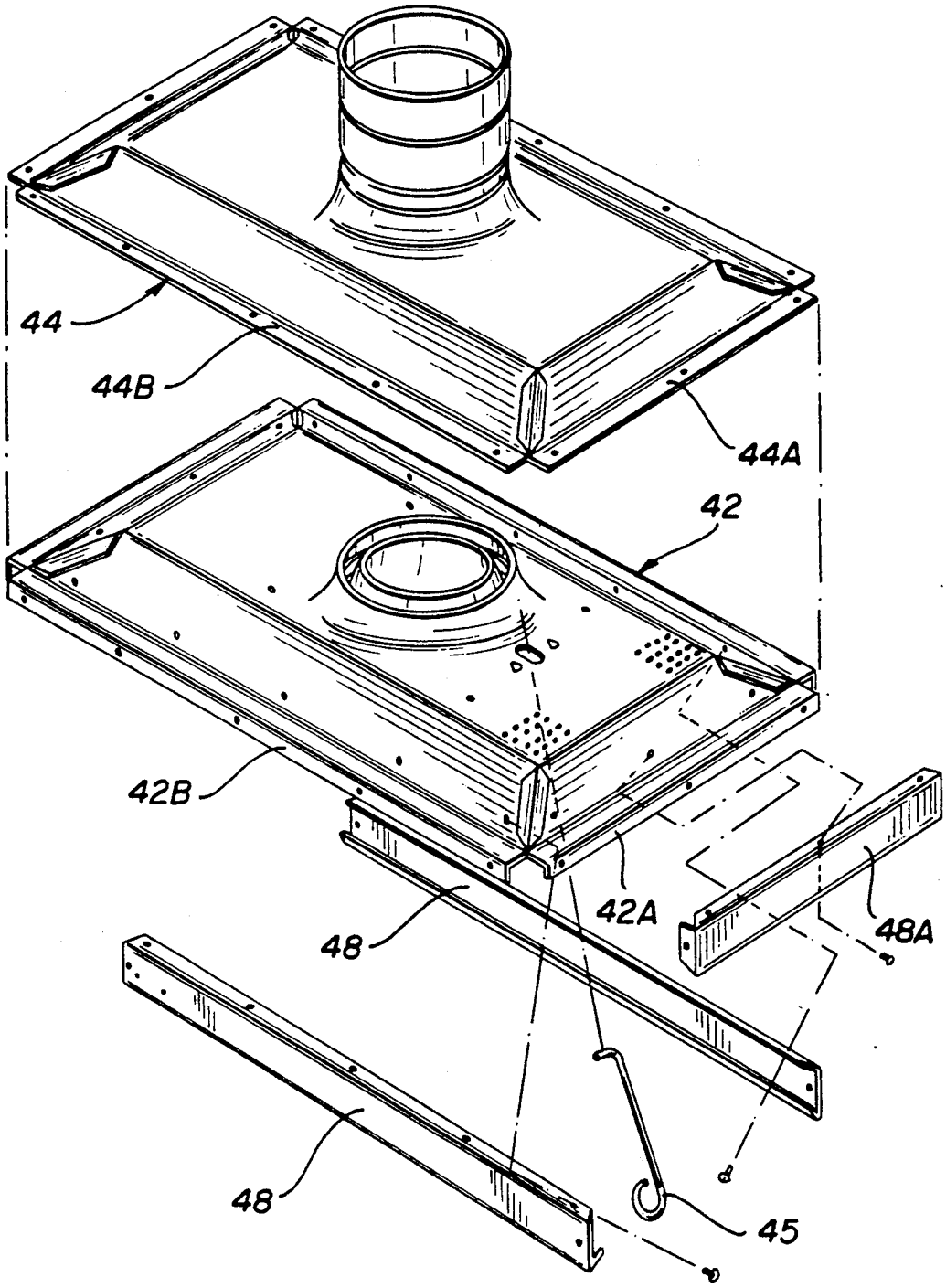
FIG. 2C is a top perspective view showing the combustion dome assemblies thereof.
Figure 2D:
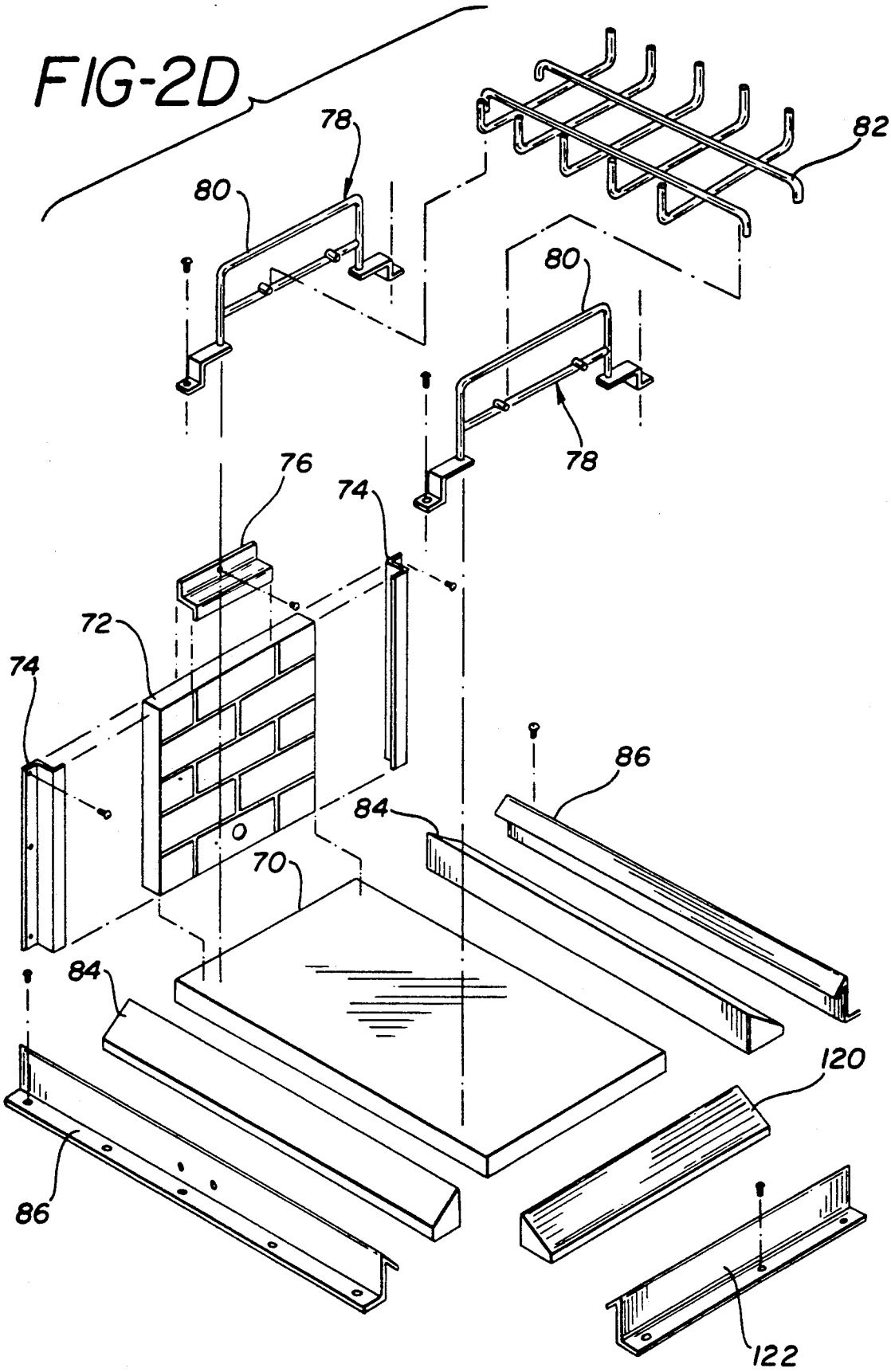
FIG. 2D is a top perspective view showing the hearth brick assembly and associated components thereof.
Figure 3:
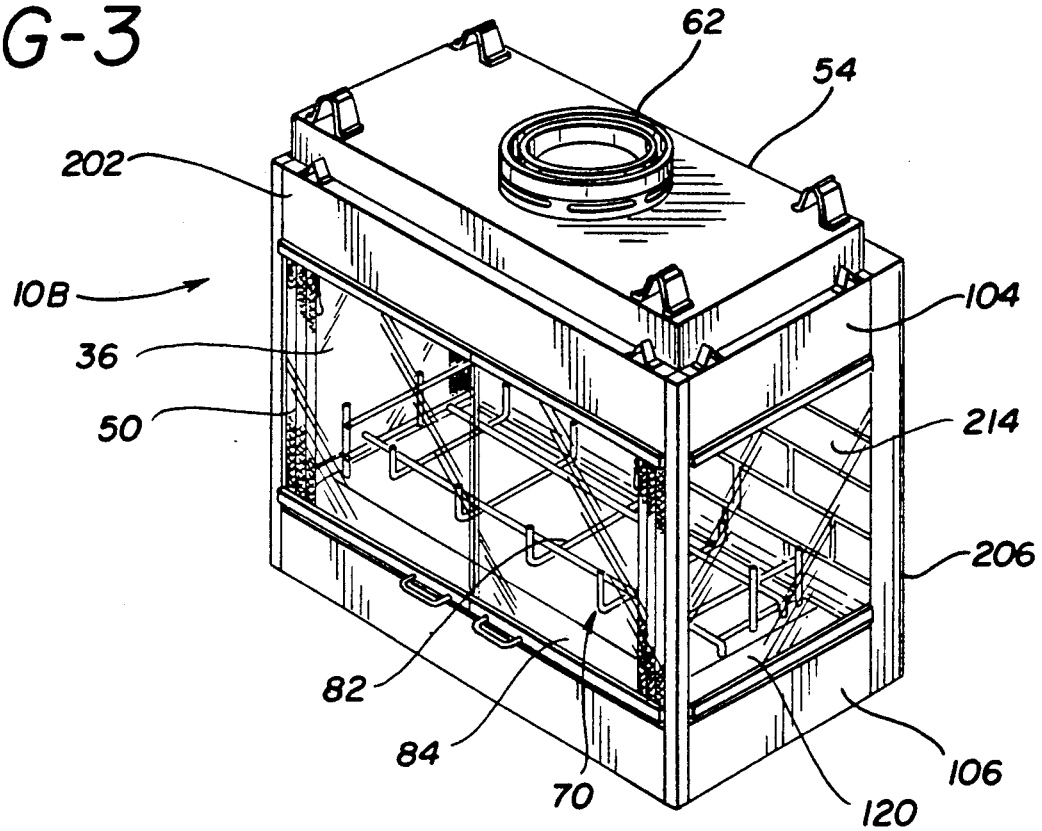
FIG. 3 is a top perspective view showing a bay type fireplace according to the invention.
Figure 4:
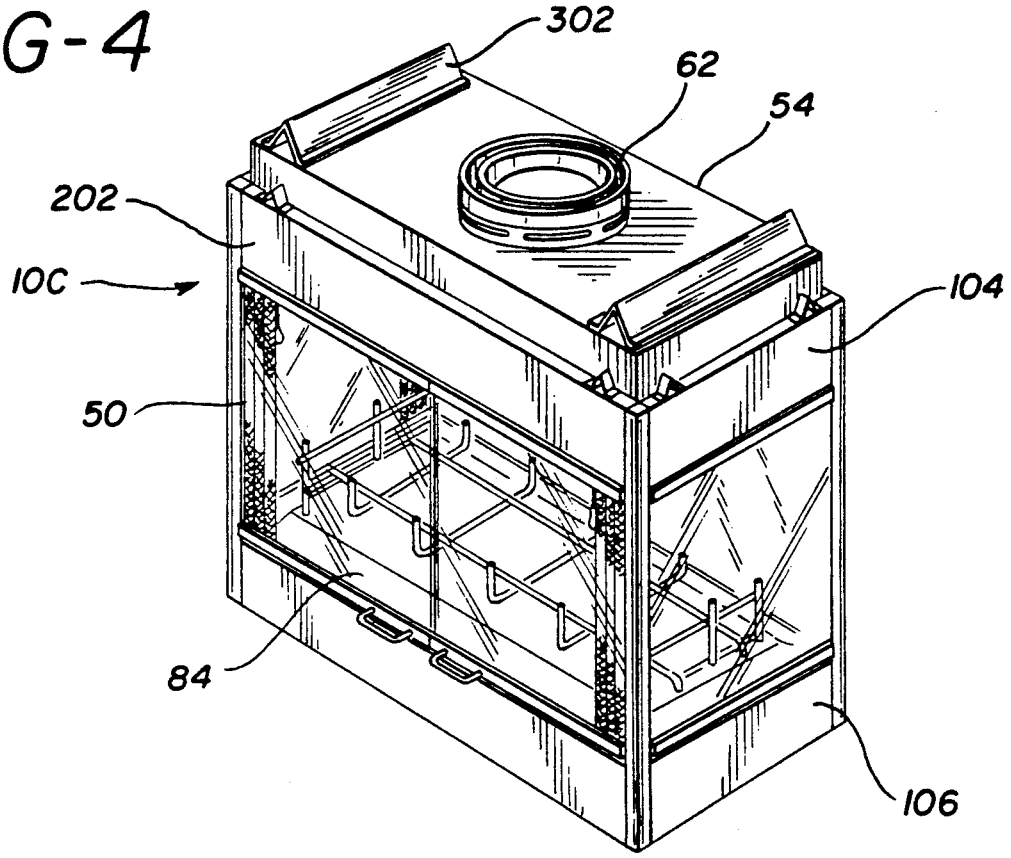
FIG. 4 is a top perspective view of an island type fireplace according to the invention.
Figure 3A:
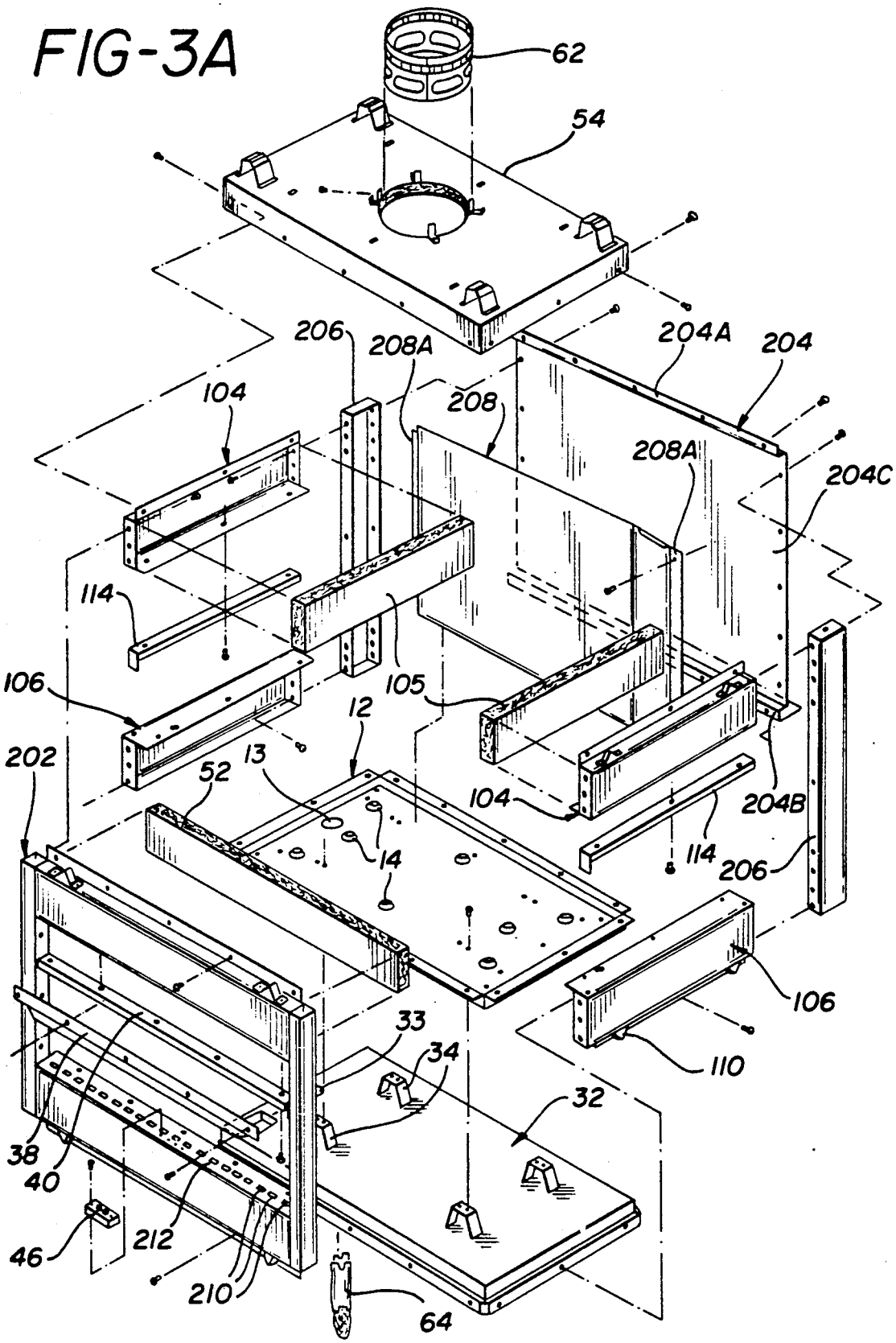
FIG. 3A is an exploded, top perspective view showing certain components thereof which define a combustion chamber.
Figure 3B:
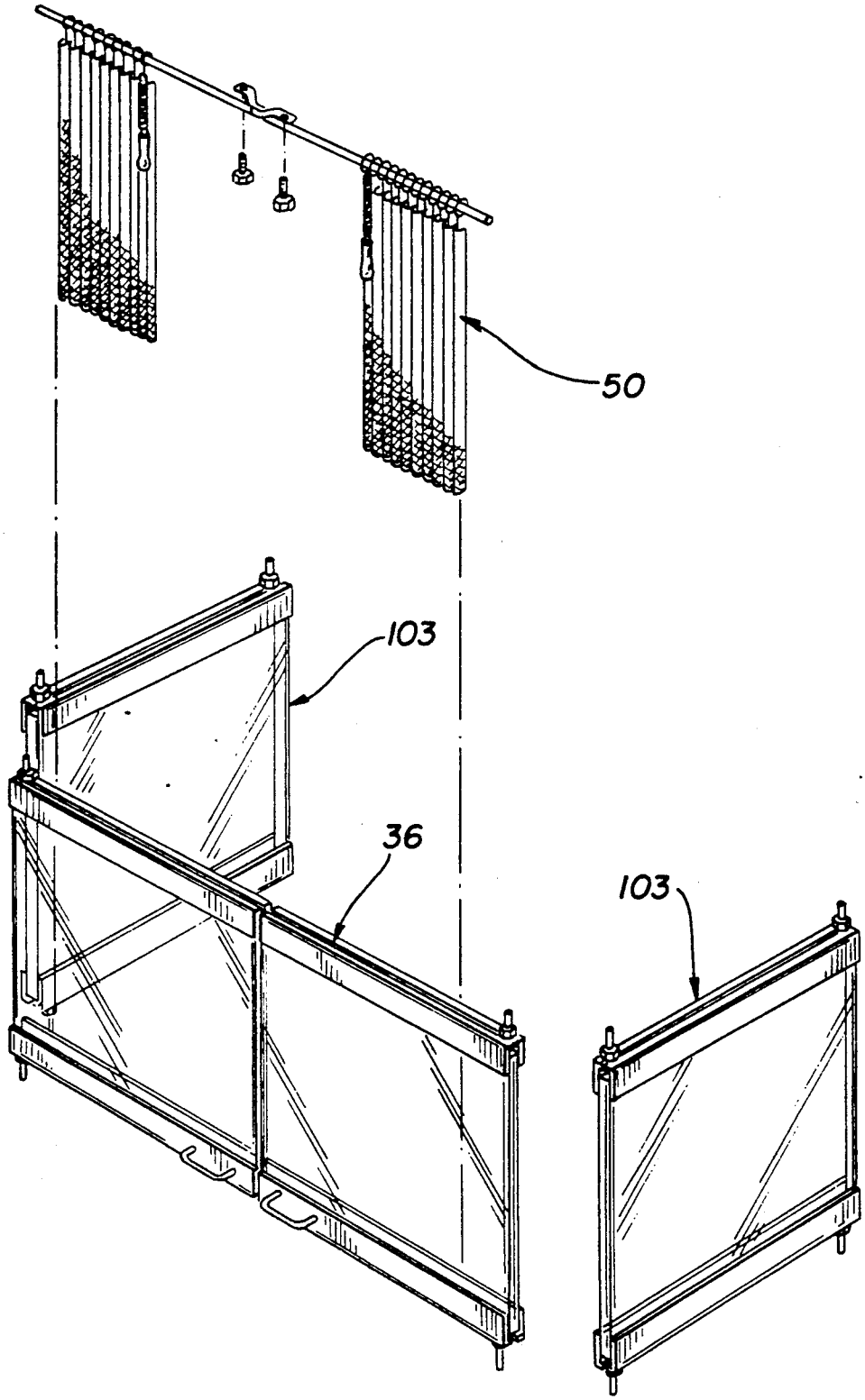
FIG. 3B is a perspective view showing the door and window assemblies thereof.
Figure 3C:
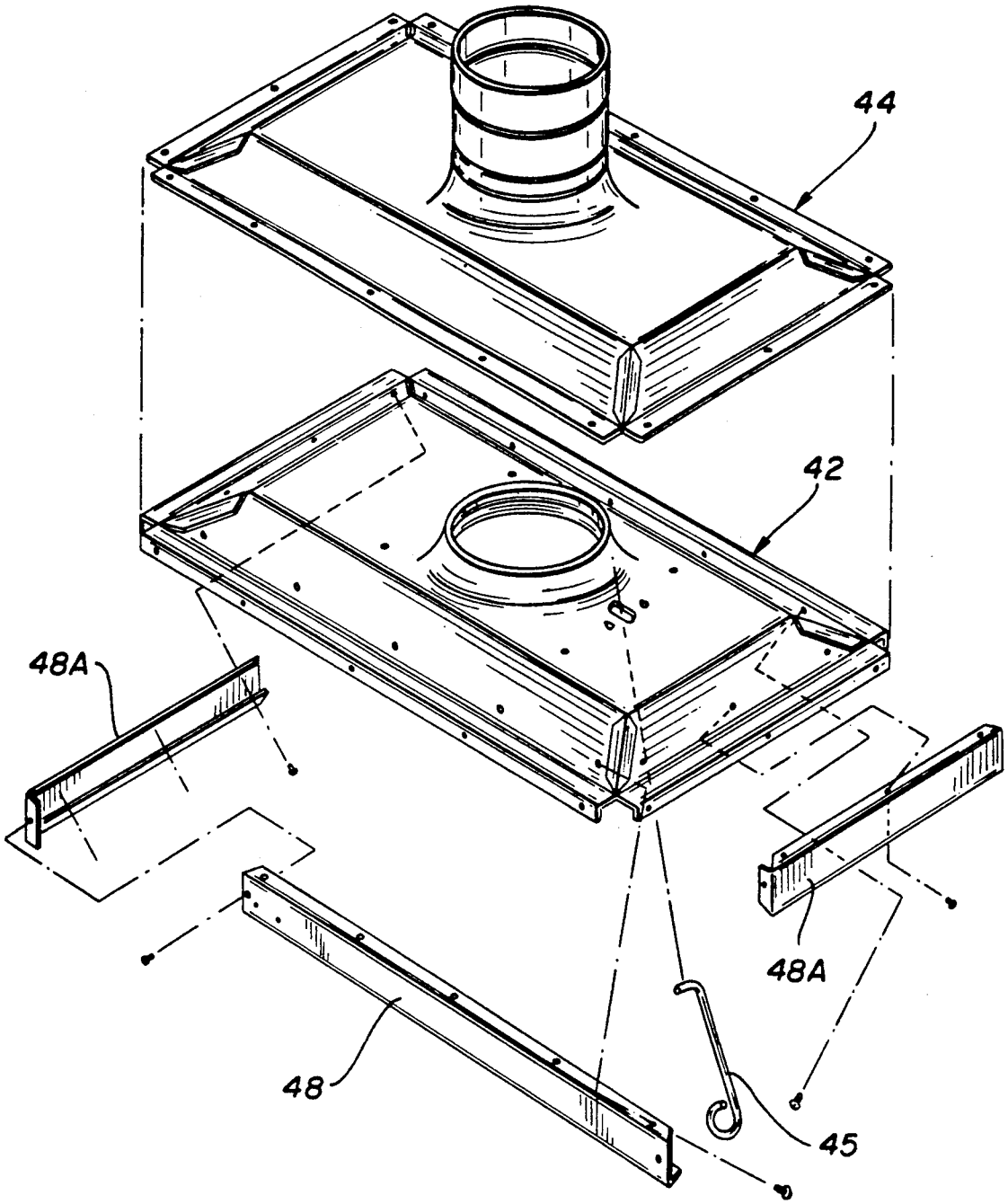
FIG. 3C is a top perspective view showing the combustion dome assemblies thereof.
Figure 3D:
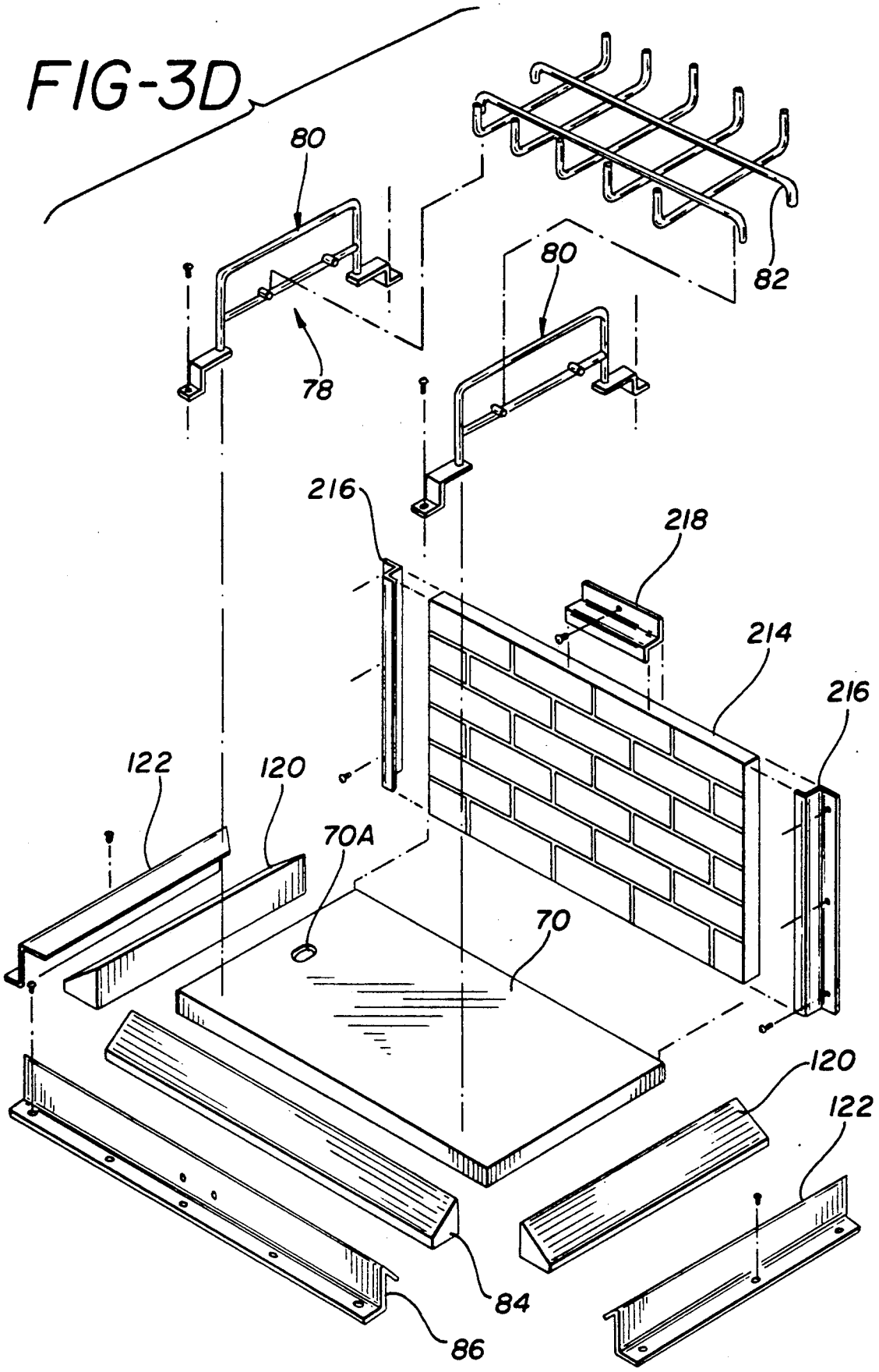
FIG. 3D is an exploded, top perspective view showing the hearth brick assembly and associated components thereof.
Figure 4A:
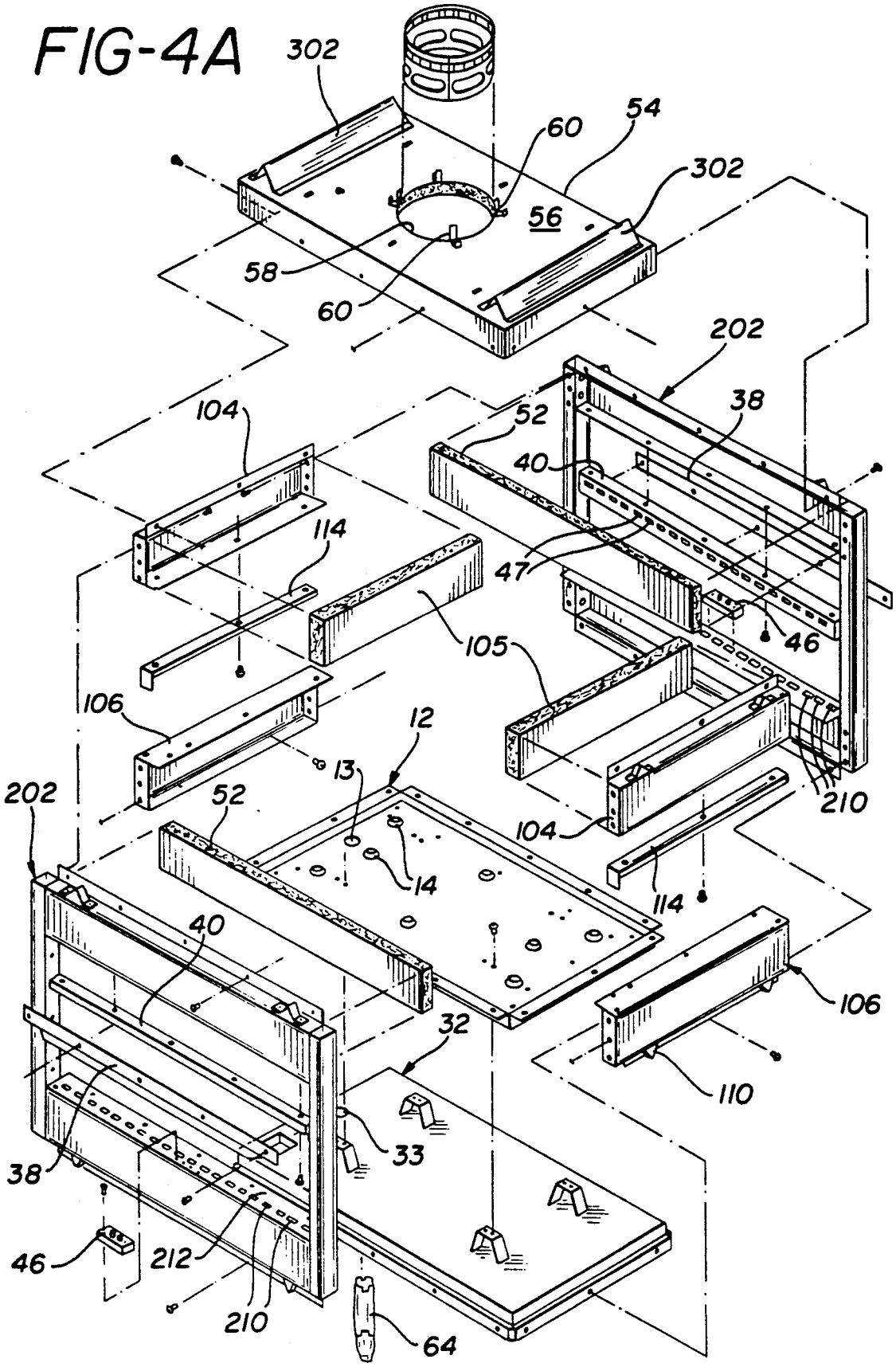
FIG. 4A is an exploded, top perspective view of certain components thereof which define a combustion chamber.
Figure 4B:
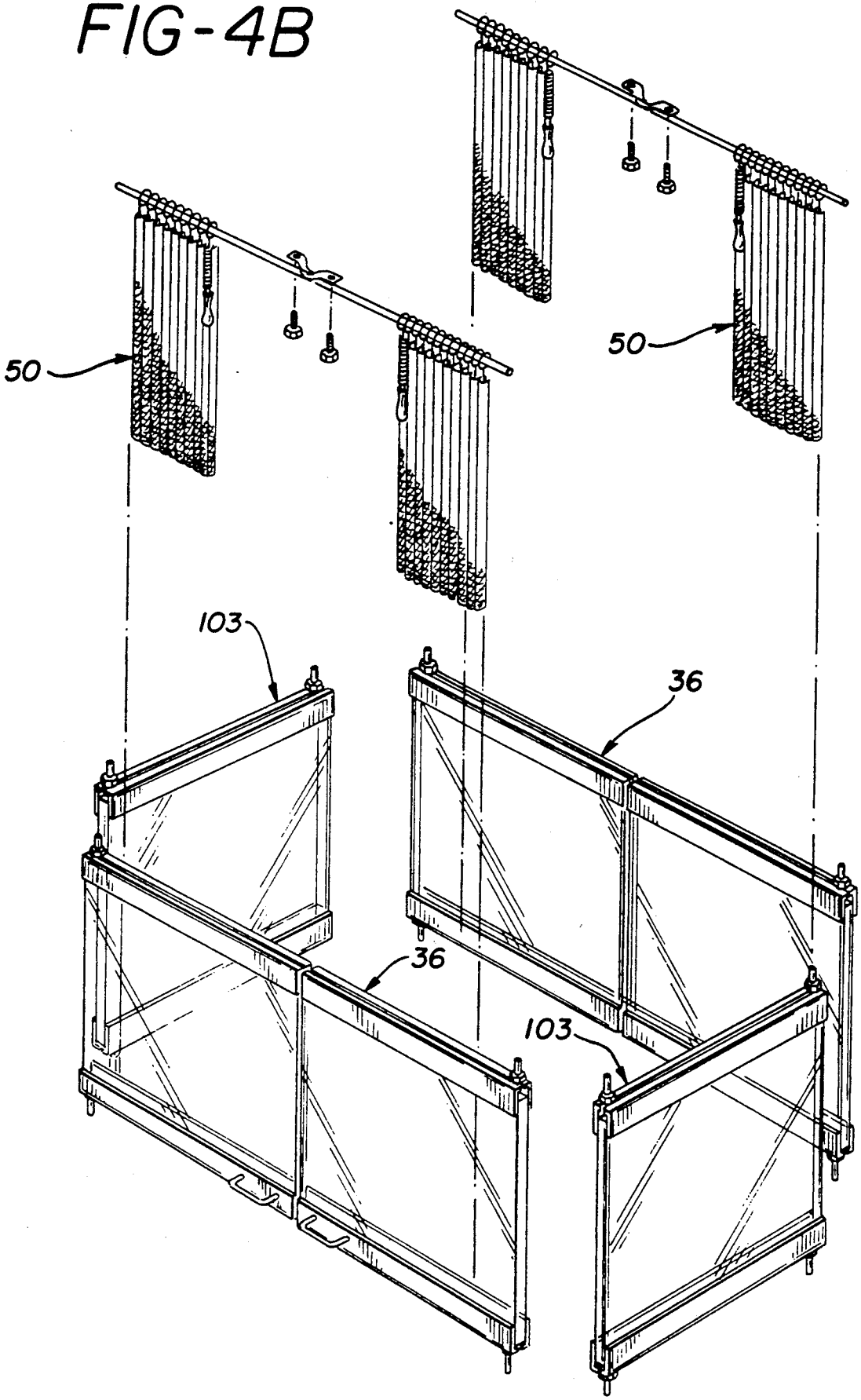
FIG. 4B is a top perspective view showing the door, window and screen assemblies thereof.
Figure 4C:
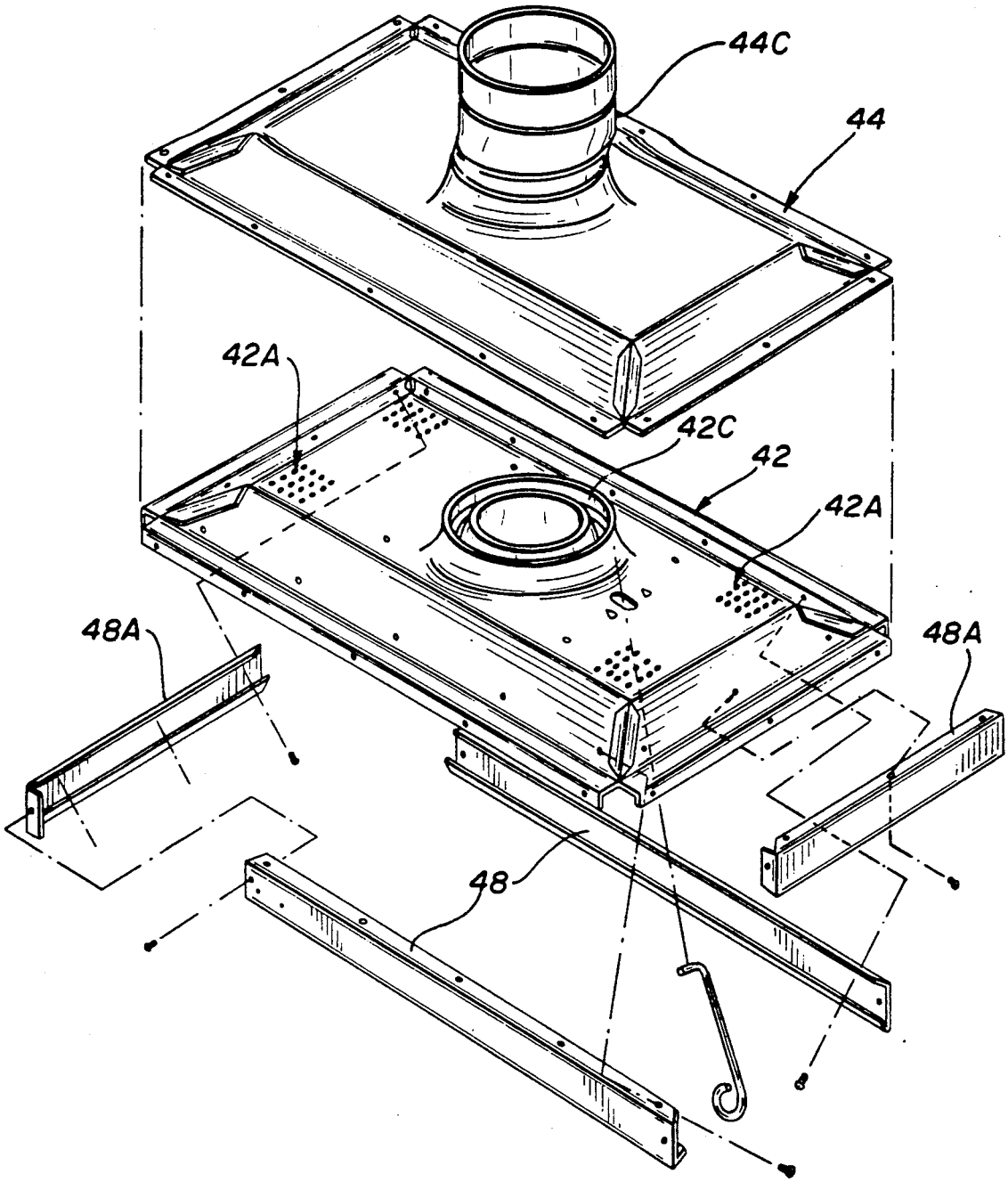
FIG. 4C is a top perspective view showing the combustion dome assemblies thereof.
Figure 4D:
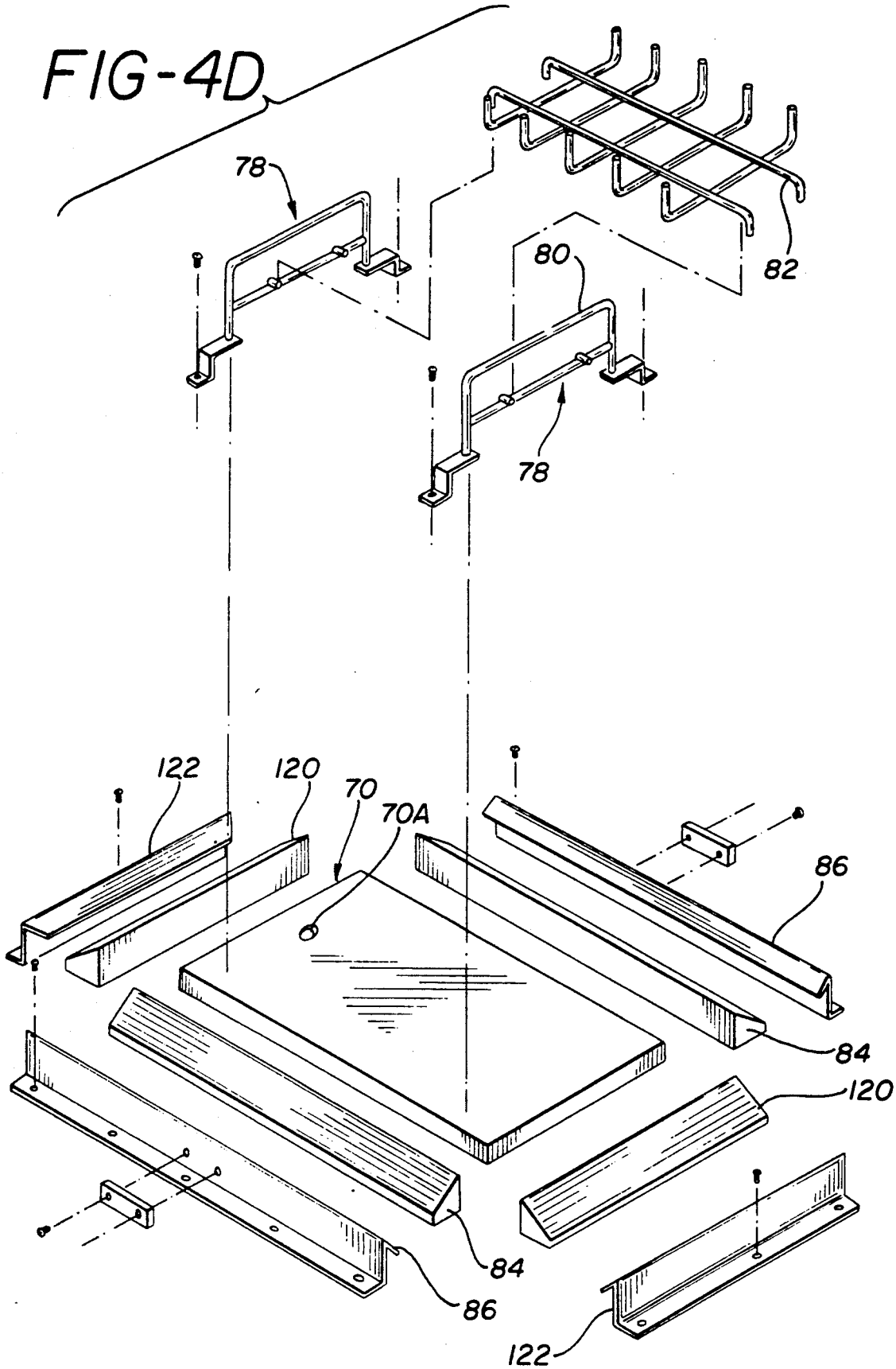
FIG. 4D is an exploded, top perspective view showing the hearth brick assembly and associated components thereof.

The combustion chamber of the fireplace 10 is defined by the opposing door assemblies 36, a hearth brick assembly 70 (FIGS. 1E,1G) which is supported by the projections 14 extending from the hearth pan 12, a pair of opposing side brick assemblies 72, and the primary combustion dome assembly 42. Referring to FIG. 1G, each side brick assembly 72 is secured to one of the combustion casing sides 28 by a pair of side retainers 74 and a top retainer 76.

A pair of grate retainers 78 are secured to the hearth pan 12 and extend between the front and rear ends of the hearth brick assembly 70. Each grate retainer includes a rail 80 to which a grate 82 is secured.

A pair of wedge-shaped front brick assemblies 84 are positioned in adjoining relation to the front and rear edges of the hearth brick assembly 70. It will be appreciated that all of the "brick" assemblies employed in the fireplace can be constructed from real brick or other ceramic materials formed to resemble brick. Ash guards 86 are secured to the respective front brick assemblies.

When all of the above parts are assembled, a see-through fireplace 10 as shown in FIG. 1 is provided. The fireplace operates in the manner described in the above-referenced U.S. application Ser. No. 552,255. The individual parts employed in the see-through fireplace are, in many cases, usable in one or more different types of fireplaces, as described hereafter.

Referring to FIGS. 2 and 2A–2D, a cove type fireplace 10A may be assembled using many of the same parts incorporated in the see-through fireplace. For example, the hearth pan 12 is identical to that used in the see-through fireplace, as are the outer casing assembly 30 and combustion casing 28 which define one end of the unit. The base pan assembly 32, door assemblies 36, seals 38 and tracks 40 are also the same in each unit. The secondary dome assembly 44 and outer top assembly 54 are two additional major parts shared by the two units. The same reference numerals are used to indicate substantially identical parts throughout this specification.

The surround assemblies 102A, 102B employed in the cove type fireplace are similar to those in the see-through fireplace. The only difference is in one end portion which is adapted to support an end glass panel assembly 103 (FIG. 2B) rather than a combustion casing side and outer casing assembly. Specifically, the one end portion of each surround assembly 102A,102B supports a top surround end 104 and a bottom surround end 106. The top surround end 104 includes an upwardly extending flange 108 and a plurality of brackets 110 in opposing relation to the flange. The bottom surround end 106 includes a downwardly extending flange 112 and a set of brackets 110 in opposing relation thereto. An end door track 114 is secured to the top surround end 104. An end glass panel assembly 103 is secured to the door track 114 and the upper wall of the bottom surround end 106. The hearth pan 12 is also secured to the upper wall of the bottom surround end.

The primary and secondary combustion dome assemblies 42,44 (FIG. 2C) are secured tot he surround assemblies in substantially the same manner as described with respect to the see-through fireplace 10. In addition, a pair of horizontally extending fasteners secure the side door track 114 to the primary combustion dome assembly. Vertically extending fasteners secure the side door track 114 to the top surround end 104 and secondary combustion dome assembly, respectively. The secondary combustion dome assembly includes horizontally extending flanges 44A,44B to facilitate such attachment. Vertically extending flanges 42A,42B facilitate attachment of the primary combustion dome assembly 42. The upper flange 108 of the top surround end 104 is secured to one of the edges of the outer top assembly 54. Side smoke shelf 48A is secured to the primary combustion dome assembly 42 as well as front smoke shelves 48 as used in the see-through and cove type fireplaces.

The combustion chamber of the cove type fireplace 10A includes generally the same elements as the see-through fireplace except near the end glass panel. An end brick assembly 120 and a side ash guard 122 are provided near one edge of the hearth brick assembly 70. Like the front ash guards 86, the side ash guard is secured to the hearth pan 12.

Referring to FIGS. 3 and 3A–3D, a bay type fireplace 10B includes a number of parts common to the see-through and/or cove fireplaces discussed above. Since the rear wall is opaque and both side walls are transparent, the front surround assembly and rear wall are accordingly different from those used in the see-through and cove fireplaces.

The bay type fireplace 10B includes a hearth pan 12 which is substantially identical to the hearth pan 12 used in the see-through and cove fireplaces, but has an opening 13 therein for receiving the gas line tube 64. The base pan assembly 32 is also substantially the same as in the other two models with the exception of a circular opening 33 aligned with the opening 13 in the hearth pan 12.

The front surround assembly 202 is adapted to be secured to a pair of end portions substantially the same as the partially transparent end portion of the cove top fireplace. Transparent end glass panels 103 (FIG. 3B) provide views of the combustion chamber from both sides of the fireplace. Screen assemblies 50 are mounted adjacent to the doors 36 and end glass panels 103, respectively.

The rear portion of the bay type fireplace 10B includes an outer casing assembly 204 which includes upper and lower vertically extending flanges 204A,204B. The rear wall 204C of the outer casing assembly includes two sets of parallel openings. Fasteners extend through these openings, and secure the outer casing assembly to a pair of vertical columns 206. The top and bottom surround ends 104,106 are also secured to the vertical columns. Each surround end also has an end secured to the front surround assembly 202. Insulation 105 is secured to the top surround ends 104.

A combustion casing 208 is secured to the vertical columns 206 by fasteners which extend through a pair of laterally extending flanges 208A thereof. A horizontally extending flange (not shown) of the combustion casing is seated upon the hearth pan 12, and is secured thereto by screws or rivets. A space is accordingly defined between the combustion casing 208 and the outer casing assembly 204.

The primary and secondary combustion dome assemblies 42,44 (FIG. 3C) and outer top assembly 54 are mounted to the bay type fireplace 10B in substantially the same way as they are to the see-through fireplace 10. A damper actuator 45 is mounted to the secondary combustion dome assembly for moving a damper (not shown). Air is provided to the combustion chamber and between the combustion dome assemblies through slots 210 in the horizontally extending wall 212 of the front surround assembly 202 and in the upper door track 40, respectively.

The interior of the bay type fireplace (FIG. 3D) includes a hearth brick assembly 70 and a front brick assembly 84. Side ash guards 122 are located outside the respective end brick assemblies 120, while a front ash guard 86 is positioned adjacent the front brick assembly 84.

A back brick wall assembly 214 is mounted to the combustion casing 208 by a pair of retainers 216 and a top retainer 218. The transparent sides of the bay type fireplace are otherwise substantially identical to those of the cove type fireplace 10A.

A fourth type of fireplace which may be constructed is the island type fireplace 10C as shown in FIGS. 4 and 4A–4D. This fireplace has four transparent sides, but is otherwise similar in structure and operation to the fireplaces discussed above.

The island type fireplace 10C includes a hearth pan 12, front and rear surround assemblies 202 substantially identical to the front surround assembly of the bay type fireplace 10B. The top and bottom surround ends 104,106, which in part define the side wall assemblies of the unit, are the same as those used in the bay and cove type fireplaces discussed above. The primary and secondary combustion dome assemblies 42,44 (FIG. 4C) are substantially the same as those used in all of the previously discussed fireplaces. Smoke shelves 48,48A are provided about all four sides as all sides of the island type fireplace are transparent. The primary combustion dome assemblies of the cove and island type fireplaces include rows of openings 42A extending therethrough. These openings allow a limited flow of air from the combustion chamber into the space between the combustion dome assemblies. Like all of the other units, each combustion dome includes an opening in the form of a nozzle 42C,44C. When assembled to the side wall assemblies of the fireplaces, the nozzles are aligned, thereby creating considerably suction between the combustion dome assemblies. Air is accordingly drawn in through the slots 47 in the door tracks 40 which are secured to the respective front and rear surround assemblies 202.

The door assemblies 36, transparent end glass panels 103, screen assemblies 50 and outer top assembly 54 are substantially the same as those used in one or more of the fireplaces discussed above. The outer top assembly 54 of the island type fireplace 10C includes standoffs 302 different from those used in the other types of fireplaces.

The interior of the combustion chamber (FIG. 4D) includes a hearth brick assembly 70, a pair of front brick assemblies 84, and a pair of end brick assemblies 120. Like the bay type fireplace, the hearth brick assembly includes an opening 70A through which the gas line tube 64 may pass. This opening is aligned with the openings 13,33 in the hearth pan 12 and base pan assembly 32, respectively.

The various surround assemblies, combustion casings, and the hearth pan, base pan assembly, combustion dome assemblies and outer top assembly may all be constructed from galvanized or aluminized steel. The hearth brick assembly 70, side brick assemblies 72, front brick assemblies 84, and back brick assembly 214 are preferably not actually made from bricks, but rather from a refractory material which tends to reflect heat. Refractory materials are employed to reduce the amount of heat lost by the fireplaces. Such materials are well known to the art.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for constructing a plurality of different types of self-supporting fireplaces without the use of a frame, comprising:

a first front surround assembly including a pair of first opposing vertical supports and a pair of first opposing horizontal supports extending between said first opposing vertical supports, said first front surround assembly including first means for supporting a first transparent door assembly;

a second front surround assembly including a pair of second opposing vertical supports and a pair of second opposing horizontal supports extending between said second opposing vertical supports, said second front wall assembly including means for supporting a second transparent door assembly;

a hearth pan including mounting means for mounting said hearth pan to either of said first and second front surround assemblies;

a plurality of first side wall assemblies, each side wall assembly including a combustion casing, an outer casing, a space defined between said combusion casing and outer casing, and mounting means for mounting said first side wall assembly to at least one of the pair of first opposing vertical supports of said first front surround assembly;

a plurality of second side wall assemblies, each second side wall assembly including a top surround end, a bottom surround end, and mounting means for mounting said second side wall assembly to at least one of the pair of second opposing vertical supports of said second front surround assembly such that said top surround end is substantially parallel to said bottom surround end, said second side wall assembly including means for supporting a transparent panel;

a base pan assembly including means for securing said base pan assembly in spaced relation to said hearth pan;

a first rear surround assembly including a pair of opposing vertical supports and a pair of opposing horizontal supports extending between and coupled to said opposing vertical supports, said first rear surround assembly including means for supporting a transparent glass door assembly and means for securing said first rear surround assembly to at least one of said first and second side wall assemblies;

a second rear wall assembly including mounting means for securing said second rear wall assembly to at least one of said first and second side wall assemblies; and a top wall assembly securable to said first and second front surround assemblies and to said first rear surround and second rear wall assemblies, wherein said first front surround assembly, a pair of said first side wall assemblies, said first rear surround assembly, said hearth pan, said base pan assembly and said top wall assembly can be assembled to form a see-through fireplace, and wherein said second front surround assembly, at least one second side wall assembly, said second rear wall assembly, said hearth pan, said base pan assembly and said top wall assembly can be assembled to form a fireplace of a type different from said see-through fireplace.

2. An assembly as described in claim 1 wherein said second rear wall assembly is opaque; and said second front surround assembly, a pair of said second side wall assemblies, said second rear wall assembly, said hearth pan, said base pan assembly and said top wall assembly can be assembled to form a bay type fireplace.

3. An assembly as described in claim 1 wherein said second rear wall assembly includes an opening extending therethrough and means for supporting a transparent door assembly; and wherein said second front surround assembly, a pair of said second side wall assemblies, said second rear wall assembly, said hearth pan, said base pan assembly and said top wall assembly can be assembled into an island type fireplace.

4. An assembly as described in claim 1 wherein said second rear wall assembly includes an opening extending therethrough and means for supporting a transparent door assembly; said first side wall assembly including mounting means for mounting said second side wall assembly to the vertical supports of said second front surround assembly; wherein said second front surround assembly, said first side wall assembly, said second side wall assembly, said second rear wall assembly, said hearth pan, said base pan assembly and said top wall assembly can be assembled to form a cove type fireplace.

5. An assembly as described in claim 1 including first and second substantially identical transparent door assemblies, said first door assembly being secured to said first front surround assembly and said second door assembly being secured to said first rear surround assembly.

6. An assembly as described in claim 1 including a primary combustion dome assembly and a secondary combustion dome assembly, said primary and secondary combustion dome asemblies each including means for coupling with said first and second front surround assemblies such that said combustion dome assemblies are oriented substantially parallel to said hearth pan and to each other, each of said combustion dome assemblies further including an opening extending vertically therethrough.

7. An assembly as described in claim 6 wherein each of said front surround assemblies include first means for admitting air between said primary and secondary combustion dome assemblies.

8. An assembly as described in claim 7 wherein each of said front surround assemblies include means for admitting air beneath said hearth pan.

* * * * *